US005957302A

United States Patent [19]

Douglas

[11] Patent Number: 5,957,302

[45] **Date of Patent: *Sep. 28, 1999**

[54] MOBILE SCREENING APPARATUS

[76] Inventor: Patrick Joseph Douglas, Southerlee, College Green, Castletown, Isle of Man 1M9 1BE, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,733

[22] PCT Filed: May 24, 1995

[86] PCT No.: PCT/GB95/01189

§ 371 Date: Mar. 21, 1996

§ 102(e) Date: Mar. 21, 1996

[87] PCT Pub. No.: WO96/03225

PCT Pub. Date: Feb. 8, 1996

[30] Foreign Application Priority Data

| | | | |
|---|---|---|---|
| Jul. 21, 1994 | [GB] | United Kingdom | 9414733 |
| Oct. 21, 1994 | [GB] | United Kingdom | 9421231 |
| May 1, 1995 | [GB] | United Kingdom | 9508806 |

[51] Int. Cl.[6] ..... B07B 1/28; B07B 1/46

[52] U.S. Cl. ..... 209/421; 209/420; 209/257

[58] Field of Search ..... 209/420, 421, 209/257; 198/311, 313, 632, 167; 180/9.1

[56] References Cited

U.S. PATENT DOCUMENTS

| | | | |
|---|---|---|---|
| 2,696,289 | 12/1954 | Lehman | 198/9 |
| 3,606,957 | 9/1971 | Fuzzell | 214/776 |
| 4,363,725 | 12/1982 | Morita et al. | 209/257 |
| 4,664,791 | 5/1987 | McClain et al. | 209/421 |
| 4,861,461 | 8/1989 | Utterback | 209/234 |
| 5,106,490 | 4/1992 | McDonald | 209/240 |
| 5,120,433 | 6/1992 | Osadchuk | 209/235 |
| 5,183,160 | 2/1993 | McClain | 209/234 |
| 5,271,168 | 12/1993 | Wilson, Sr. et al. | 37/142.5 |

FOREIGN PATENT DOCUMENTS

| | | | |
|---|---|---|---|
| 7334449 | 10/1932 | France | E02F 7/06 |
| 5033359 | 2/1993 | Japan | E02F 3/32 |

*Primary Examiner*—William E. Terrell
*Assistant Examiner*—Patrick Mackey
*Attorney, Agent, or Firm*—Madson & Metcalf

[57] ABSTRACT

A self-propelled screening apparatus (10) having a support frame (11), endless crawler tracks (15) supporting the frame (11), a hopper (13) and screen or screens (12) mounted on the support frame (11), and a discharge conveyor (14) mounted on the frame (11) and operable to discharge at least one separated portion of screened material (received from the screen) along a required deposition zone while the apparatus is moving.

14 Claims, 6 Drawing Sheets

MOBILE SCREENING APPARATUS

This invention relates to a mobile screening apparatus of the general type which comprises a frame, a screen mounted on said frame, a hopper for receiving a supply of screenable material and for feeding said material to the screen so as to be separated-out into screened portions of different size ranges, means for discharging the separated portions of screened material from the apparatus, and moving means supporting said frame and operable to move the apparatus over the ground.

The invention seeks in particular to provide an improved mobile screening apparatus of the type referred to above, and which can be used to carry out screening operations while moving over the ground, and to discharge separated portions of the screened material to required deposition zones.

It is of course well known to provide static screening plants, in the sense that all screening operations e.g. in a quarry installation, take place while the screening plant is located at a fixed site, although the plant can be transported from one site to another when required. To achieve easy transportation, it is known to provide a towable screening plant which has a forward towing hitch, and which has one or more wheelsets to enable the plant to be towed behind a towing vehicle. However, it is mobile only in the sense that it can be towed from one site to another, after conversion to a transport mode, and actual screening operations can only take place after the plant has been installed at the new site, and usually after conversion of the plant from the transport mode to an operative mode. This generally involves unfolding discharge conveyors, and any other component parts which project outwardly in use.

It is also known to provide travelling hoppers to discharge material from the hoppers onto a prepared site e.g. during laying of hard core to form the base of a motorway carriageway, in which the hopper moves back and forward between a pair of side rails, and also moves progressively along each rail at the end of each path of movement, so that the prepared site becomes filled progressively with hard core.

The invention seeks to provide a mobile screening apparatus which is capable of (1) receiving a supply of screenable material; (2) screening the material e.g. into, at least two different size ranges of screened material; (3) discharging the separated material; and (4) carrying out all of these operations while the plant is moving, if required, so as to deposit at least one separated portion of screened material in a required deposition zone.

According to the invention there is provided a mobile screening apparatus which comprises:

- a support frame;
- moving means supporting said frame and operable to move the apparatus over the ground;
- a screen mounted on said support frame, and a hopper arranged to receive a supply of screenable material and to discharge the material to the screen so that the latter can separate the material into screened portions of material; and,
- discharge means mounted on the frame and operable to discharge at least one separated portion of screened material along a required deposition zone while the apparatus is being moved by said moving means.

The invention therefore provides a self-propelled screening apparatus or plant which is capable of receiving a supply of screenable material, separating the material e.g. into at least two size ranges of which preferably one includes so-called "fines", and discharging at least one of the separated range of screened material to a required deposition zone along which the apparatus is moved via said moving means.

Preferably, the discharge means comprises a discharge conveyor arranged to receive said one separated range of material from the screen, and to convey the material outwardly of the frame of the apparatus. The conveyor may be adjustably mounted on the frame, so that the discharge end of the conveyor can be adjusted laterally and/or upwardly and downwardly to vary its position relative to the frame.

The conveyor may be mounted to slew about an upright axis which is a substantially vertical axis when the apparatus is on level ground to adjust itself laterally, and about a substantially horizontal axis to vary the discharge height of the end of the conveyor.

Conveniently, the conveyor is mounted at one end of the frame of the apparatus, and the driver's cab may be mounted at the opposite end, and with the hopper and screen arranged between them.

The moving means may comprise any suitable form of driven ground-engaging members, but a preferred arrangement comprises a pair of endless tracks, which is a particularly advantageous way to carry out lateral adjustment of the discharge end of the conveyor.

The apparatus may be used to screen and then distribute screened material, while on the move, in many different operating environments e.g. in the laying of hard core on a building site, or the sub-base of a roadway, or in laying "fines" to fill pipeline trenches after the pipelines have been laid.

The screen which is mounted in the apparatus may take any suitable design, and may comprise one or more screen deck, and preferably with means to apply vibration energy to the screen deck(s) to improve the screening operation. The screen(s) preferably is arranged to extend generally perpendicular to the longitudinal axis of the apparatus (and of the endless track) so that the material which is too large to be screened i.e. which does not pass through the screens, can be discharged to one side of the apparatus, and therefore will not obstruct the movement of the apparatus and of its endless tracks.

To provide alternative (or additional) lateral adjustment of the conveyor relative to the endless tracks (and also of the hopper/screens and main superstructure of the apparatus), a slew ring type of mounting platform may be provided which pivotally mounts the superstructure on a base frame on which the endless tracks are mounted.

A preferred embodiment of mobile screening apparatus according to the invention will now be described in detail, by way of example only, with reference to the accompanying drawings, in which.

Figure 1:
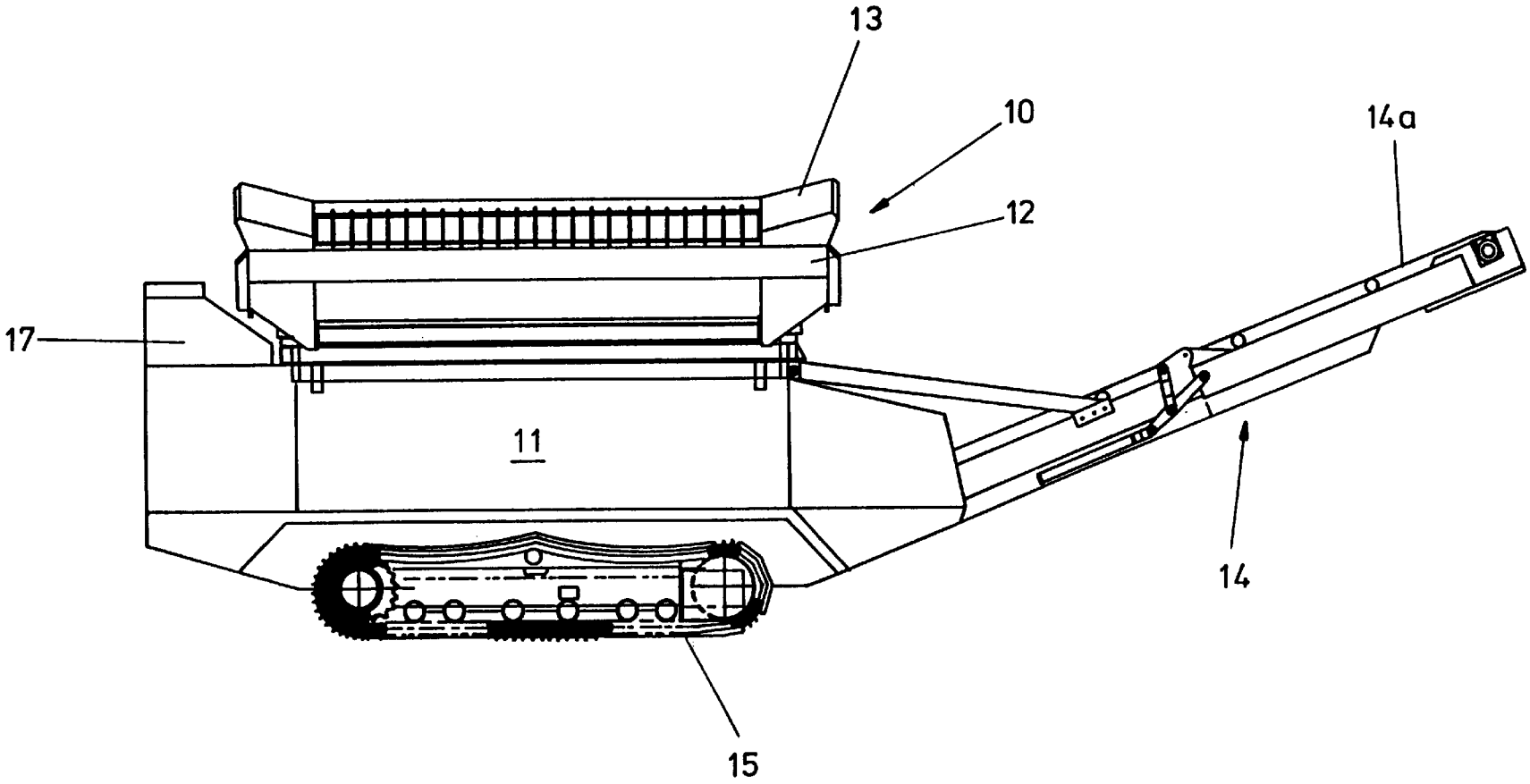
FIG. 1 is a side view of the mobile screening apparatus, and with a discharge conveyor shown unfolded to an operative position.
Figure 2:
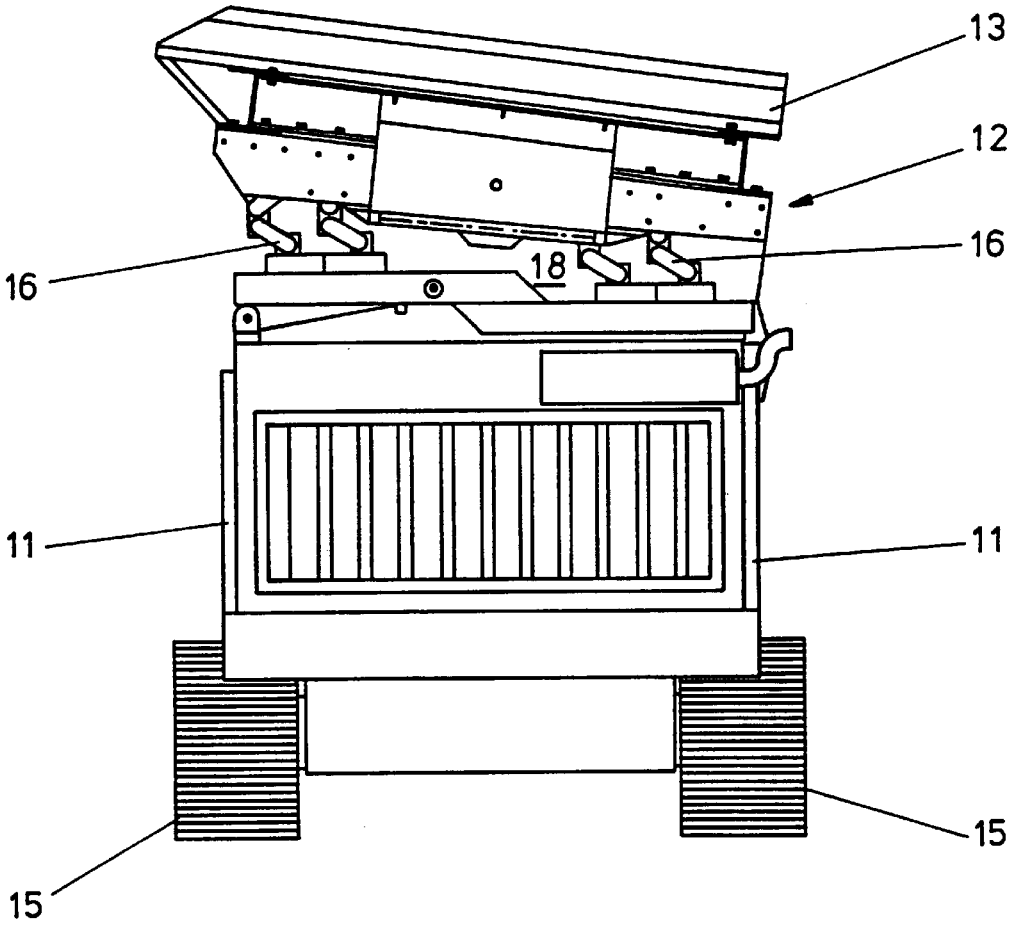
FIG. 2 is a view from one end of the apparatus.

Referring now to the drawings, there is shown a preferred embodiment of mobile screening apparatus which is designated generally by reference 10, and which is a self-propelled apparatus comprising a support frame 11, a screen designated generally by reference 12 mounted on support frame 11, a hopper 13 for receiving a supply of screenable material and for feeding such material to the screen 12 so as to be separated out into screened portions of different size ranges, means for discharging the separated portions from the apparatus, and taking the form of a discharge conveyor designated generally by reference 14, and moving means in the form of a pair of endless tracks 15 which support the frame 11 and are operable to move the apparatus 10 over the ground.

The screen 12 may take any suitable form, and preferably comprises at least one screen deck, and the entire screen 12 may be mounted on the upper end of frame 11 via suitable flexible linkages 16, and provided with suitable means to apply vibrational energy to the screen 12 in order to assist the screening process.

It should be noted that the screen(s) 12 extends generally perpendicular to the longitudinal axis of the apparatus (and of the endless tracks) and therefore oversize material which does not pass through the screens can be discharged laterally of the endless tracks and therefore will not obstruct the movement of the apparatus.

Screen 12 can separate the screenable material into at least two size ranges of screened material e.g. to produce so-called "fines" which are separated from larger material which may be disposed of separately for other uses. The discharge means, in the form of discharge conveyor 14, is mounted at the front end of frame 11 and is operable to discharge at least one of the separated range of screened material e.g. the "fines" along a required deposition zone while the apparatus 10 is being moved by the endless tracks 15.

The discharge conveyor 14 projects from the frame 11, when in the operative position shown in FIG. 1, and conveys the screened material outwardly of the frame of the apparatus, for discharge to required locations. The conveyor 14 may be arranged to be pivotally adjustable with respect to the frame 11 about a substantially vertical axis (by suitable mounting means not shown in detail in FIGS. 1 to 4), so that it can be slewed to carry out lateral adjustment, and is also capable of being adjusted upwardly and downwardly about a substantially horizontal axis in order to vary the discharge height of the discharge end of the conveyor 14.

Figure 3:
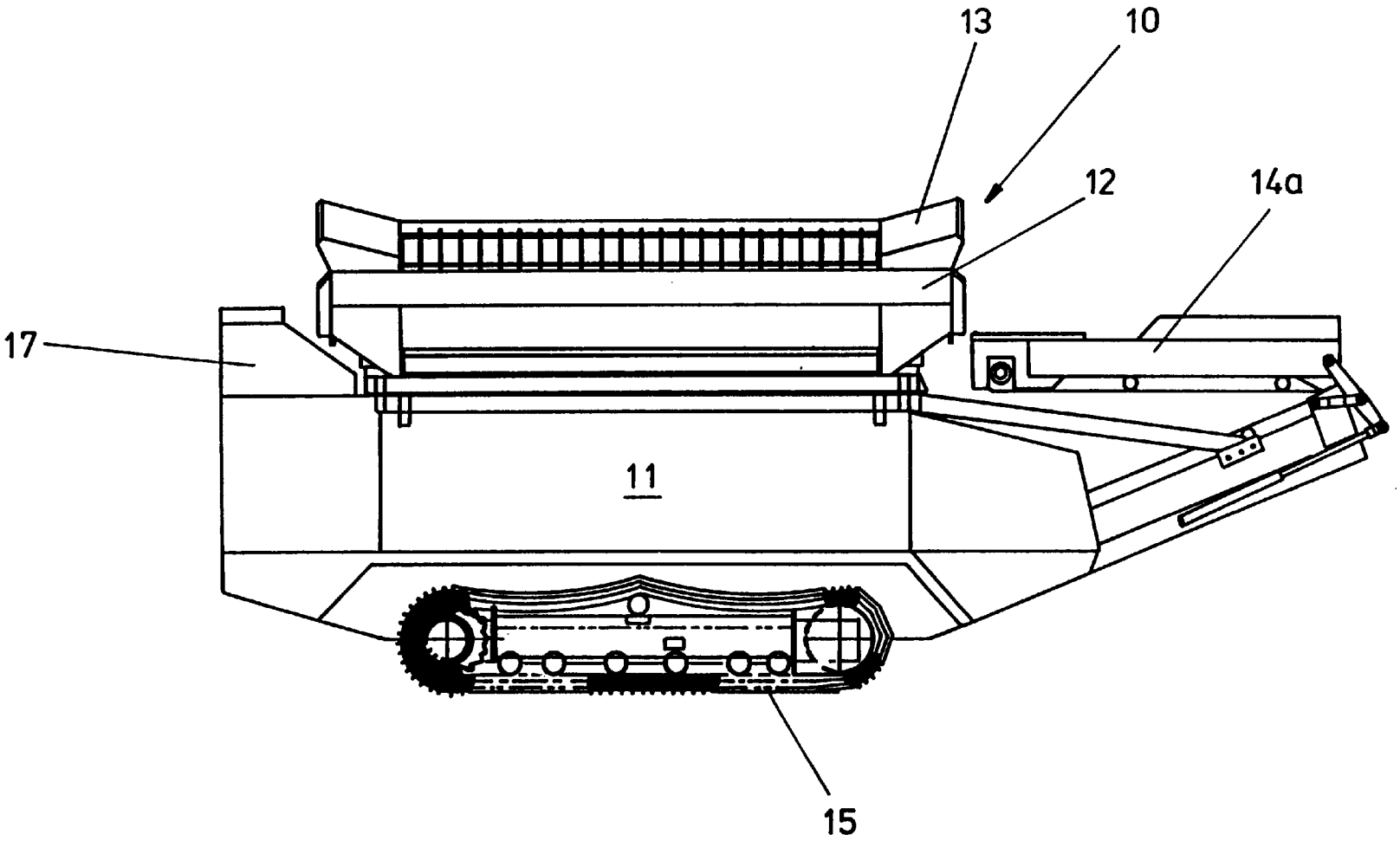
FIG. 3 is a view, similar to FIG. 1, showing the discharge conveyor in a folded position.
Figure 4:
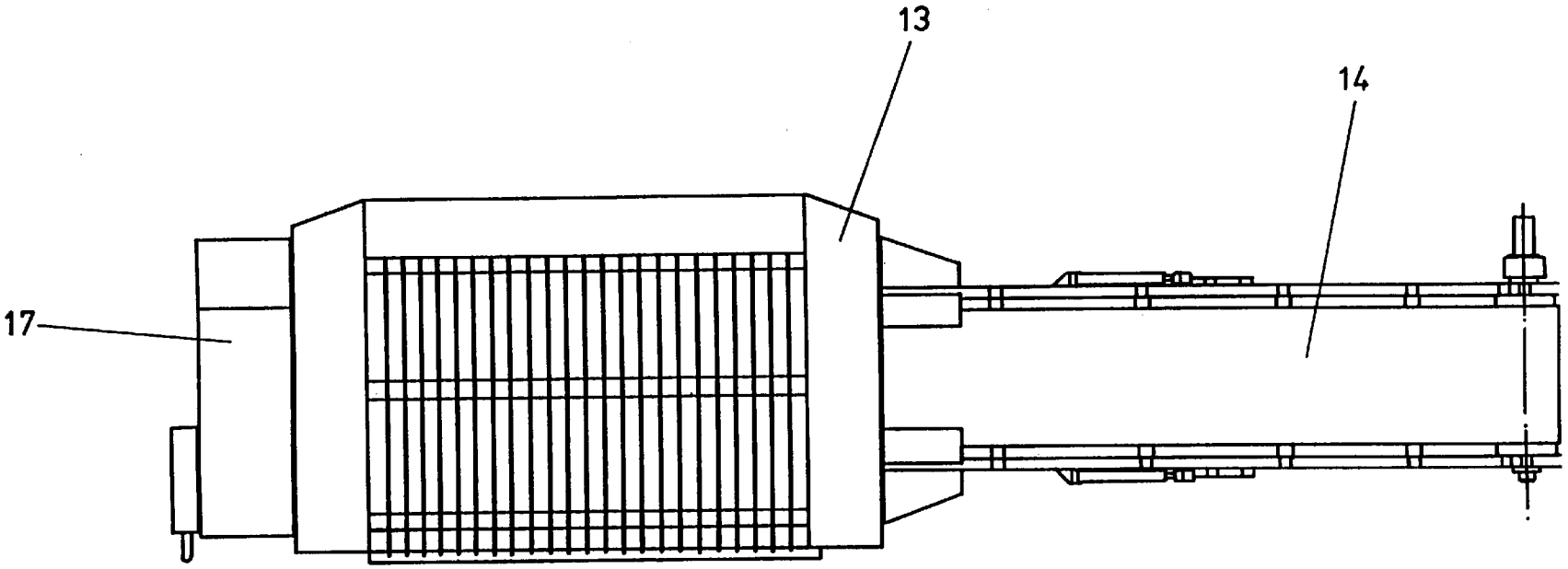
FIG. 4 is a plan view of the apparatus.

FIG. 3 shows an inwardly folded position of a discharge end portion 14*a* of the conveyor 14, which it may take-up when the apparatus is inoperative.

The discharge conveyor 14 is mounted at the front end of the frame 11, and the driver's cab 17 may be mounted at the opposite end, and giving a field of view to the driver through the space 18 (see FIG. 2) defined below the screen 12, so that the discharge operation for the fines via the discharge conveyor 14 can be watched. This also assists in the adjustment of the discharge conveyor 14, as well as assisting the driver to follow a required path of movement.

The apparatus 10 may be used to screen and then distribute screened material, while on the move, in many different environments. By way of example, it may be used to lay hard core on a building site, or to form the base of a roadway. Alternatively, it may be used to lay "fines" to fill pipeline trenches after the pipelines have been laid.

In some circumstances, it may be desirable for the discharge conveyor 14 to project from the frame 11 generally in the direction of movement of the apparatus, whereas in other situations it may be desirable for it to project generally perpendicular to the path of movement, so that screened material can be deposited to one side of the apparatus.

Although not shown, the apparatus may be arranged so as to be capable of remote operation e.g. via an umbilical, or a remote control arrangement such as an infra red transmitter control device.

Figure 5:
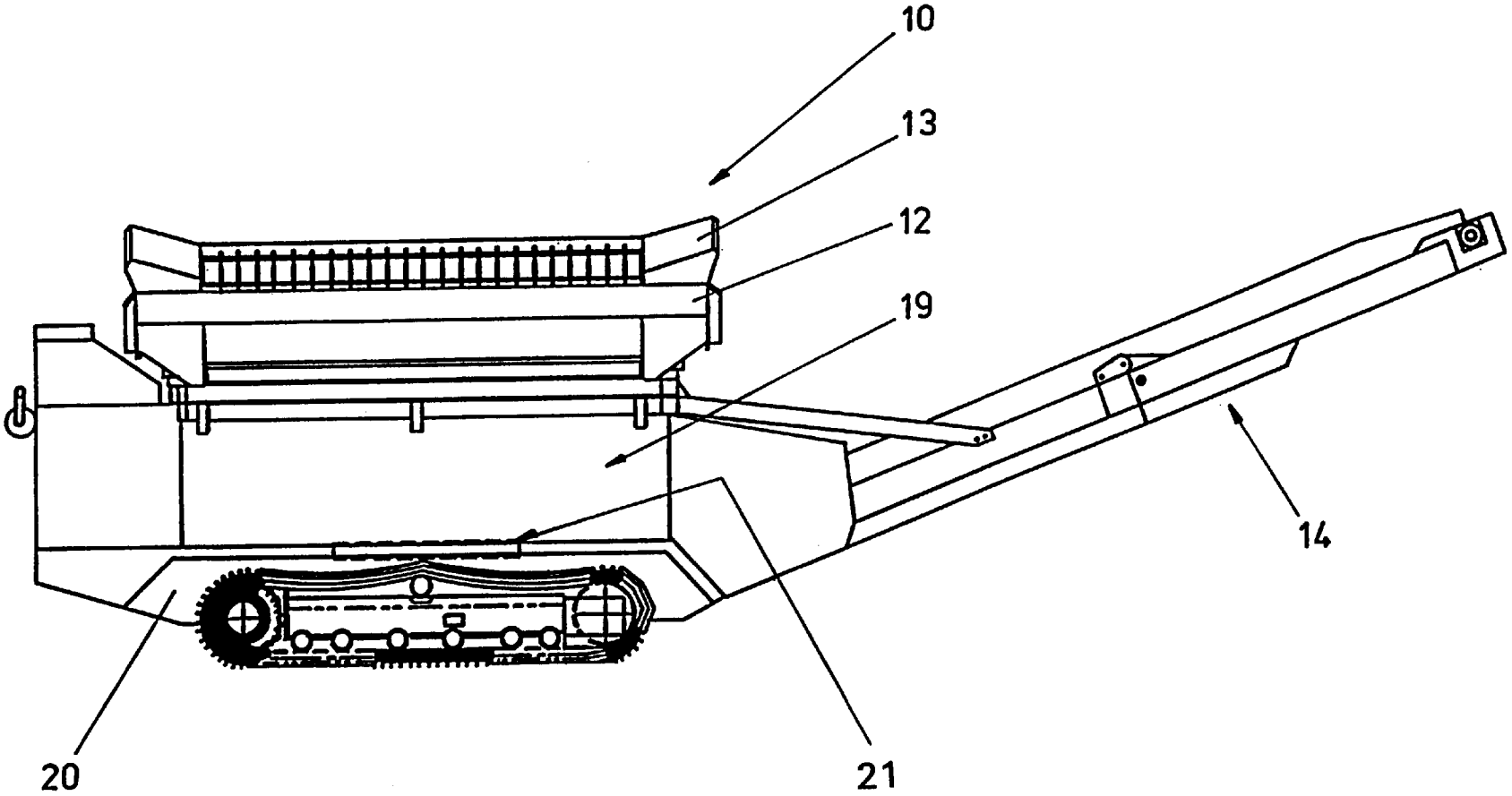
FIG. 5 is a view, similar to FIG. 1 and showing a slew ring mounting as a preferred additional component.
Figure 6:
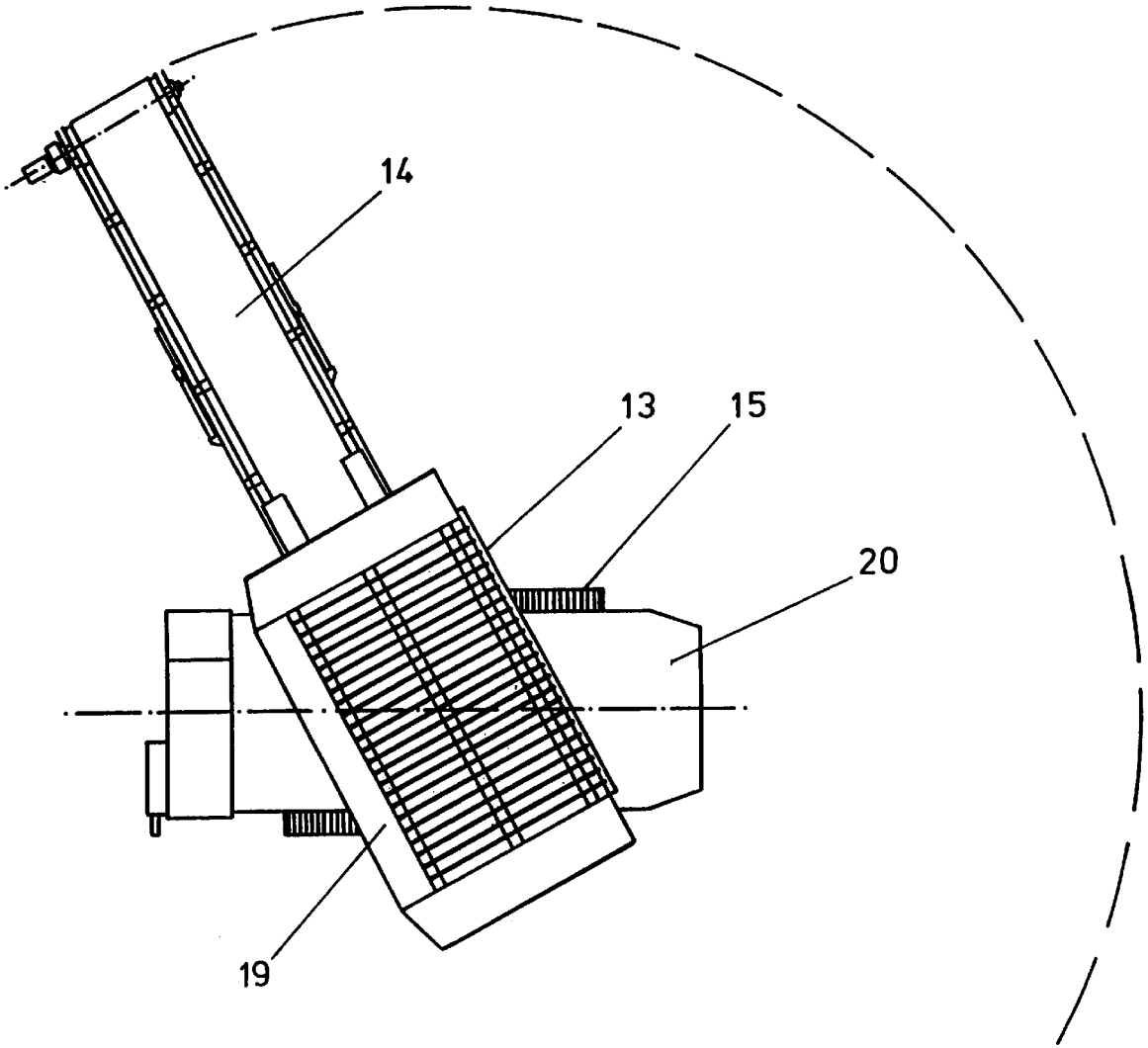
FIG. 6 is a plan view corresponding to FIG. 5.

Referring now to FIGS. 5 and 6, this shows a slew ring mounting which is a preferred additional component, to provide additional, or alternative means for lateral adjustment of the conveyor relative to the endless tracks (and also of the hopper/screens and the main superstructure of the apparatus). The slew ring is shown by reference 21, and this pivotally mounts the main superstructure 19 on a base frame 20 on which the endless tracks 15 are mounted.

We claim:

1. A self-propelled screening apparatus comprising:

a support frame having a longitudinal axis and a pair of opposed sides;

a pair of driven endless tracks each supporting a respective one of said opposed sides of said frame such that said endless tracks move the apparatus over the ground, each track extending substantially throughout the length of the respective frame side;

a screening device of substantially the same length as said endless tracks and overlaying said endless tracks and fixedly mounted on said support frame, said screening device having a sloping screen extending in a direction between said opposed sides of the support frame and generally perpendicular to said longitudinal axis for the support frame;

a hopper mounted above the screening device and arranged to receive a supply of bulk material and to discharge the material to said screen so that the latter can separate the bulk material into separate portions which comprise non-screened material which is too large to pass through the screen and screened material which passes through the screen, in which the screen is arranged to discharge the non-screened material onto the ground adjacent one of the sides of the support frame; and a discharge conveyor mounted on said support frame and projecting therefrom in a direction generally parallel to the longitudinal axis thereof, said conveyor having a discharge end and a receiving end which is arranged to receive material which has passed through the screen, and said conveyor being operable to discharge such material via the discharge end in a direction longitudinally of the support frame.

2. Apparatus according to claim 1, in which the discharge conveyor is adjustable about a transverse axis which is substantially horizontal when the apparatus is on level ground, to vary the discharge height of the end of the conveyor.

3. Apparatus according to claim 1, in which the discharge conveyor includes an innermost portion and an outermost portion hingedly connected together, and adjustable between an operative position in which one of the portions forms a prolongation of the other, and an inoperative folded position in which the outermost conveyor portion is inwardly pivoted so as to occupy a space adjacent to said hopper and said screen and thereby to reduce the overall length of the apparatus.

4. Apparatus according to claim 1, in which said endless tracks support said frame directly, whereby the lateral position of the discharge end of the conveyor is adjustable by selective operation of the endless tracks.

5. Apparatus according to claim 1, in which the support frame comprises a base frame which is supported directly by said endless tracks, and a superstructure on which said screen, said hopper and said discharge conveyor are mounted, said superstructure being pivotally mounted on said base frame so as to be capable of slewing the superstructure in order to vary the lateral projection of the discharge end of the conveyor relative to the direction of forward travel of the apparatus.

6. Apparatus according to claim 5, in which said superstructure in mounted on said base frame via a slew ring.

7. Apparatus according to claim 1, including a driver's cab mounted at one end of the frame of the apparatus, said discharge conveyor being mounted at an opposite end, and with the hopper and screen arranged between the cab and the discharge conveyor.

8. Apparatus according to claim 7, in which a space is defined below the screen and above the support frame, which provides a field of view from the cab so that the discharge operation via discharge conveyor can be watched.

9. Apparatus according to claim 1, in which the screen comprises more that one screen deck.

10. Apparatus according to claim 1, in which the apparatus includes means operative to render the apparatus capable of remote operation.

11. Apparatus according to claim 1, in which the apparatus includes means operative to render the apparatus capable of being remotely operated via an umbilical, or an infra-red transmitter control device.

12. Apparatus according to claim 1, in which the screening device is configured to screen material while the apparatus is moved by the endless tracks and while the apparatus is stationary.

13. Apparatus according to claim 1, in which the screening device is capable of screening material while the apparatus is moved by the endless tracks.

14. A self-propelled screening apparatus which is capable of screening material while it is moving comprising:

a support frame having a longitudinal axis and a pair of opposed sides;

a pair of driven endless tracks each supporting a respective one of said opposed sides of said frame such that said endless tracks move the apparatus over the ground, each track extending substantially throughout the length of the respective frame side;

a screening device of substantially the same length as said endless tracks and overlaying said endless tracks and fixedly mounted on said support frame, said screening device having a sloping screen extending in a direction between said opposed sides of the support frame and generally perpendicular to said longitudinal axis for the support frame;

a hopper mounted above the screening device and arranged to receive a supply of bulk material and to discharge the material to said screen so that the latter can separate the bulk material into separate portions which comprise non-screened material which is too large to pass through the screen and screened material which passes through the screen, in which the screen is arranged to discharge the non-screened material onto the ground adjacent one of the sides of the support frame; and a discharge conveyor mounted on said support frame and projecting therefrom in a direction generally parallel to the longitudinal axis thereof, said conveyor having a discharge end and a receiving end which is arranged to receive material which has passed through the screen, and said conveyor being operable to discharge such material via the discharge end in a direction longitudinally of the support frame.

* * * * *